US005959236A

United States Patent [19]

Smith et al.

[11] Patent Number: 5,959,236

[45] Date of Patent: Sep. 28, 1999

[54] THROUGH BULKHEAD INITIATOR

[75] Inventors: David A. Smith, St. Paul; Timothy C. Hungerford, Coon Rapids, both of Minn.

[73] Assignee: Alliant Techsystems Inc., Hopkins, Minn.

[21] Appl. No.: 09/052,644

[22] Filed: Mar. 31, 1998

Related U.S. Application Data

[63] Continuation-in-part of application No. 08/806,809, Feb. 26, 1997, abandoned.

[51] Int. Cl.[6] ..... C06C 7/00; C06C 5/06; B60R 21/28

[52] U.S. Cl. ..... 102/204; 102/200; 102/275.11; 280/741

[58] Field of Search ..... 102/204, 205, 102/202, 200, 275.4, 275.5, 275.6, 275.11; 60/255, 253, 256, 250; 280/741

[56] References Cited

U.S. PATENT DOCUMENTS

| | | | |
|---|---|---|---|
| 3,238,876 | 3/1966 | Allen | 102/275.4 |
| 3,945,322 | 3/1976 | Carlson et al. | 102/70 |
| 3,973,502 | 8/1976 | Olsen | 102/86.5 |
| 3,978,791 | 9/1976 | Lemley et al. | 102/28 |
| 3,982,488 | 9/1976 | Rakowsky et al. | 102/81 |
| 4,539,910 | 9/1985 | Stevens | 202/349 |
| 4,574,699 | 3/1986 | Bolieau | 102/202 |
| 4,592,281 | 6/1986 | Nagennast | 102/254 |
| 4,608,926 | 9/1986 | Stevens | 102/275.4 |
| 4,632,034 | 12/1986 | Colle, Jr. | 102/312 |
| 4,653,400 | 3/1987 | Crawford | 102/202 |
| 4,660,472 | 4/1987 | Stevens | 102/202.1 |
| 4,699,400 | 10/1987 | Adams et al. | 280/731 |
| 4,759,291 | 7/1988 | Barker et al. | 102/202.5 |
| 4,766,726 | 8/1988 | Tackett et al. | 60/255 |
| 4,829,765 | 5/1989 | Bolieau et al. | 60/250 |
| 5,179,246 | 1/1993 | Betts et al. | 102/201 |
| 5,196,646 | 3/1993 | Worsey | 102/293 |
| 5,204,493 | 4/1993 | Christmann et al. | 102/307 |

OTHER PUBLICATIONS

Heckes, "Through–Bulkhead–Initiator Development," Jul. 17–21, 1978, Sixth International Pyrotechnic Seminar, Estes Parl CO., pp. 238–240.

Schwarz et al., "Development of a Schock–Initiated, Through–Bulkhead Actuator," Jul. 1980, Seventh International Pyrotechnic Seminar, pp. 585–598.

Kjeldgaard et al., "Thermal Ignition of Pyrotechnics Through a Bulkhead," 1974, pp. 4–1 to 4–5.

Thivet et al., "Combustion of Redox Mixes in the T.B.I. Configuration," Mar., 1974, Symposium on Explosives and Pyrotechnics, pp. 4–37 to 4–42.

Aoki, K. et al., "Shock Ignitibility Test for Medium–Sensitive Pyrotechnic Compositions," 18th International Pyrotechnic Seminar, Jul. 1992, pp. 1–9.

Hardt, A.P. et al., "Initiation of Pyrotechnic Mixtures by Shock," Eighth Symposium on Explosives and Pyrotechnics, pp. 53–1 to 53–8, Jan. 1974.

INCONEL 718 Data Sheet, Alloy Digest, Apr. 1961 (2 sheets).

Corwin, L.W. et al., "Development of the Saturn V Thru Bulkhead Initiator," Symposium on Electroexplosive Devices, 6th, San Francisco, CA., Jul. 8–10, 1969, pp. 1–4.1 to 1–4.22.

Thivet, R. et al., ". . . of a Through Bulkhead Detonator," Eighth Intl. Pyrotechnic Seminar, Jul., 1982, pp. 928–954.

*Primary Examiner*—Charles T. Jordon
*Assistant Examiner*—Theresa M. Wesson
*Attorney, Agent, or Firm*—George A. Leone; Mark Goldberg

[57] ABSTRACT

A miniaturized bulkhead with a barrier member having a thickness in the range of less than 0.05 inches thick for separating explosive charges on opposites sides. The miniaturized bulkhead is manufactured from an age hardened nickel-base alloy. First and second cavities are separated by the barrier member integral with the initiator body. The first cavity is filled with an explosive donor charge, and the second cavity is filled with an explosive acceptor charge. The composition of the age hardened nickelbase alloy includes nickel in the range of 50–55 percent by weight.

20 Claims, 1 Drawing Sheet

THROUGH BULKHEAD INITIATOR

CROSS REFERENCE TO RELATED APPLICATION

This application is a continuation-in-part of U.S. patent application Ser. No. 08/806,809 now abandoned entitled Through Bulkhead Initiator, filed Feb. 26, 1997, having inventors David A. Smith and Timothy C. Hungerford, and assigned to the same assignee as this application.

FIELD OF THE INVENTION

The present invention relates generally to pyrotechnic systems and, more particularly, to such systems in which a downstream ignition reaction or shock wave is transmitted through a solid barrier or bulkhead to initiate an upstream explosive function.

BACKGROUND OF THE INVENTION

Through bulkhead initiators are well known, and commonly employed, particularly, in ordinance applications which have an ordinance transfer line to initiate an explosive type of ordnance device, herein referred to as an "initiator." Such initiators accept a detonating signal from an ordnance transfer device or assembly, and convert the detonating signal to a hot gas output on the downstream side of a solid barrier or bulkhead of the initiator, thereby, producing an "initiation stimulus" for an upstream ordnance subsystem. The bulkhead or barrier is intended to provide a pressure seal during operation of the upstream ordnance sub-system.

The initiation stimulus provided by a through bulkhead initiator is generally transmitted through the bulkhead via shock waves. The initiator generally includes an explosive donor charge of an explosive material which is detonated by the detonating signal. In turn, a shock wave is generated by the detonation of the explosive donor charge, transferred to the bulkhead, and propagated therethrough to an explosive acceptor charge on the upstream side of the bulkhead, and which forms, in part, the upstream ordnance subsystem. The initiator must provide a shock wave of sufficient energy to cause a detonation reaction of the explosive acceptor charge of the upstream ordnance subsystem.

As is well understood in the prior art, the bulkhead or barrier generally comprises a thin member of a larger body which may also serve as a housing which encloses the initiator explosive donor charge and initiator ordnance transfer subassembly. Outer portions of the housing may also serve structural support functions of the upstream ordnance subsystem. Further, portions of the upstream side of the bulkhead may include structural configuration features for receiving the explosive acceptor charge of the upstream ordnance subsystem.

Initiators of the prior art as just described are disclosed in, among others, the following publications: "Development of the Saturn V Thru Bulkhead Initiator," Corwin et al, North American Rockwell Corp., 6th Symposium on Electroexplosive Devices, July 1969; "Through-Bulkhead-Initiator Development," by Hecks, Sandia Laboratories, Albuquerque, N.M., 6th Pyrotechnic Seminar, 1978; "Thermal Ignition of Pyrotechnics Through a Bulkhead," by Kjeldgaard et al, Sandia Laboratories, Albuquerque, N.M., 8th Symposium on Electroexplosive Devices, 1974; and "Development of a Shock Initiated Through-Bulkhead Actuator," Schwarz et al, Sandia Laboratories, Albuquerque, New Mexico, 6th Pyrotechnic Seminar, 1980.

Further, initiators are also described in, among others, the following U.S. Patents: U.S. Pat. No. 4,608,926, issued to Stevens, entitled, "Swivel Type Through Bulkhead Initiator"; U.S. Pat. No. 4,660,472, issued to Stevens, entitled, "Optical Through Bulkhead Initiator and Safe-Arm Device;" U.S. Pat. No. 4,699,400, issued to Adams, et al, entitled, "Inflator and Remote Sensor with Through Bulkhead Initiator;" U.S. Pat. No. 4,766,726, issued to Tackett, et al, entitled "Segmented Case Rocket Motor;" and U.S. Pat. No. 4,829,765, issued to Bolieau, et al, entitled, "Pulsed Rocket Motor."

Bulkheads or barriers of prior art initiators are generally metallic, commonly stainless steel, and are of sufficient structural size to withstand the passage of the shock wave produced by the detonation of a donor charge without structural degradation. Further, such barriers or bulkheads are also designed to have sufficient structural integrity to withstand both the detonation sequence of the initiator and the operational pressure of an upstream ordinance device.

Developments in the ordnance industry have placed greater demands on the size of the initiator. At the same time, military standards have been imposed as to the type and quantities of explosive donor and acceptor charges, particularly the explosive requirements imposed by U.S. Government Military Standard Mil-Std 1316. More particularly less sensitive donor and explosive acceptor charges must now be used in such initiators.

The latter donor charge requirements affect the relationship between achieving structural integrity of the bulkhead, and at the same time establishing a sufficient shock wave resulting from detonation of the explosive donor charge to detonate the explosive acceptor charge of the upstream ordnance subsystem. Designs meeting Mil-Std 1316 have system length constraints that require reduction of bulkhead thickness. Prior art bulkheads typically use stainless steel barriers that do not exhibit acceptable shock transfer properties or strength to function at operating pressures of, for example, about 5,000 psi, when reduced in size as is required for such designs.

Known devices are limited to substantially thicker bulkheads than that provided by the instant invention as described hereinbelow. Specifically, there is no teaching or suggestion in the art to make a miniaturized bulkhead with a barrier member less than 0.05 inches thick. For example, U.S. Pat. No. 3,945,322 issued Mar. 23, 1976 to Carlson et al. does not provide such a teaching. In fact, Carlson et al. specifically limits that invention to barriers having a thickness of 0.050 to 0.140 of an inch.

The present invention overcomes shortcomings found in the prior art by providing, for the first time, a miniaturized bulkhead having a thickness of less than 0.050 inches, while still providing sufficient structural strength and shock wave properties so as to function with less sensitive explosives meeting the requirements of Mil-Std 1316.

SUMMARY OF THE INVENTION

One object of the present invention is to provide an initiator of small size having a bulkhead with sufficient structural integrity to withstand both the detonation sequence of the initiator and the operational pressure of an upstream ordnance device.

Another object of the present invention is to provide an initiator of small size and having a bulkhead with sufficient structural integrity to withstand both the detonation sequence of the initiator and the operational pressure of an upstream ordnance device while employing explosives which satisfy the requirements of Mil-Std 1316.

In accordance with the present invention, a miniaturized bulkhead with a barrier member less than 0.05 inches for separating explosive charges on opposites sides thereof while still providing sufficient structural strength and shock wave properties so as to function with less sensitive explosive charges meeting the requirements of Mil-Std 1316 is provided by way of an initiator body constructed substantially of an age hardened nickel-base alloy, wherein the composition of said age hardened nickelbase alloy includes nickel in the range of 50–55 percent by weight. The initiator body includes a first cavity bounded, in part, by a barrier member integral with the initiator body. The first cavity is substantially filled with an explosive donor charge on the down stream side of the barrier member. An explosive acceptor charge is placed in communication with the upstream side of the barrier member. The barrier member is structurally configured so that a shock wave initiated by detonating the explosive donor charge may be transferred through the barrier member to impact the explosive acceptor charge so as to cause detonation of the explosive donor charge.

Other objects, features and advantages of the present invention will become apparent to those skilled in the art through the description of the preferred embodiment, claims and drawings herein wherein like numerals refer to like elements.

BRIEF DESCRIPTION OF THE DRAWINGS

To illustrate this invention, a preferred embodiment will be described herein with reference to the accompanying drawings.

DETAILED DESCRIPTION OF THE INVENTION

Figure 1:
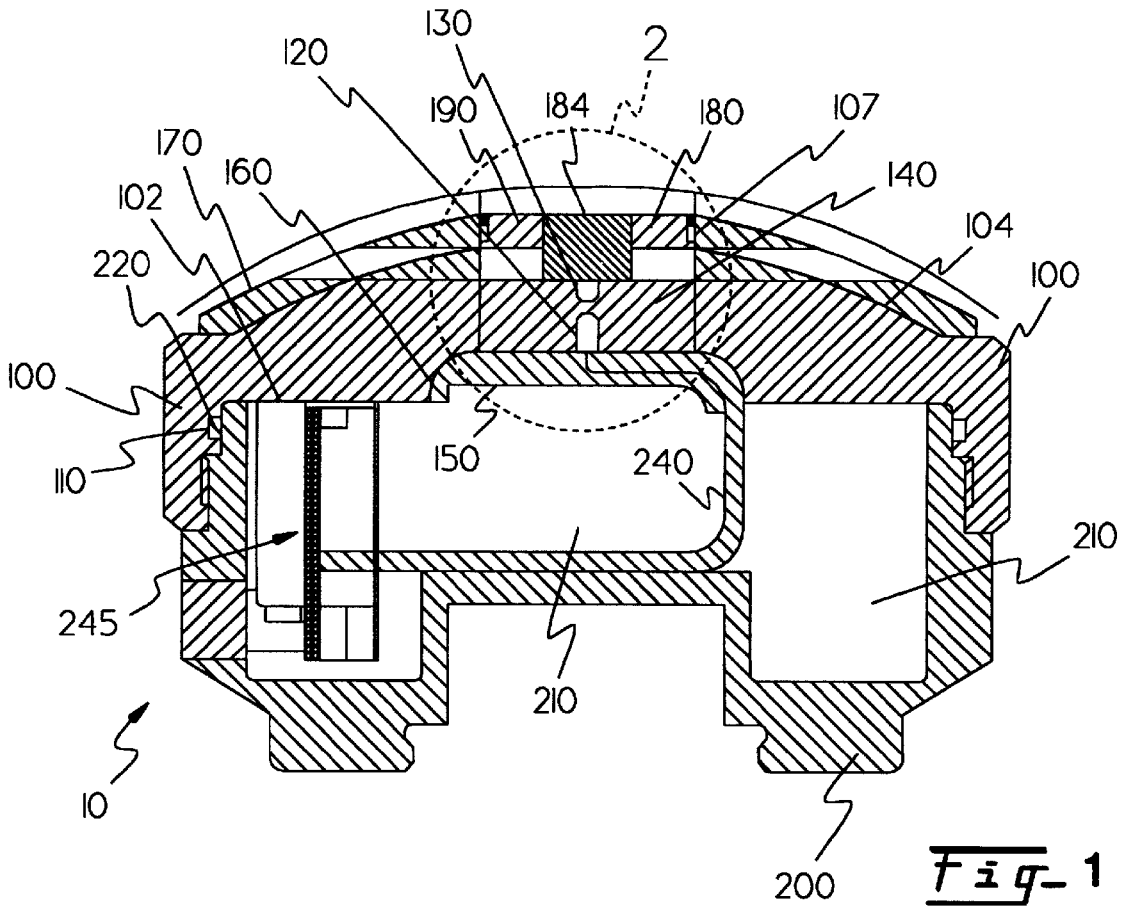
FIG. 1 is a cross sectional view of a through bulkhead initiator in accordance with the present invention.
Figure 2:
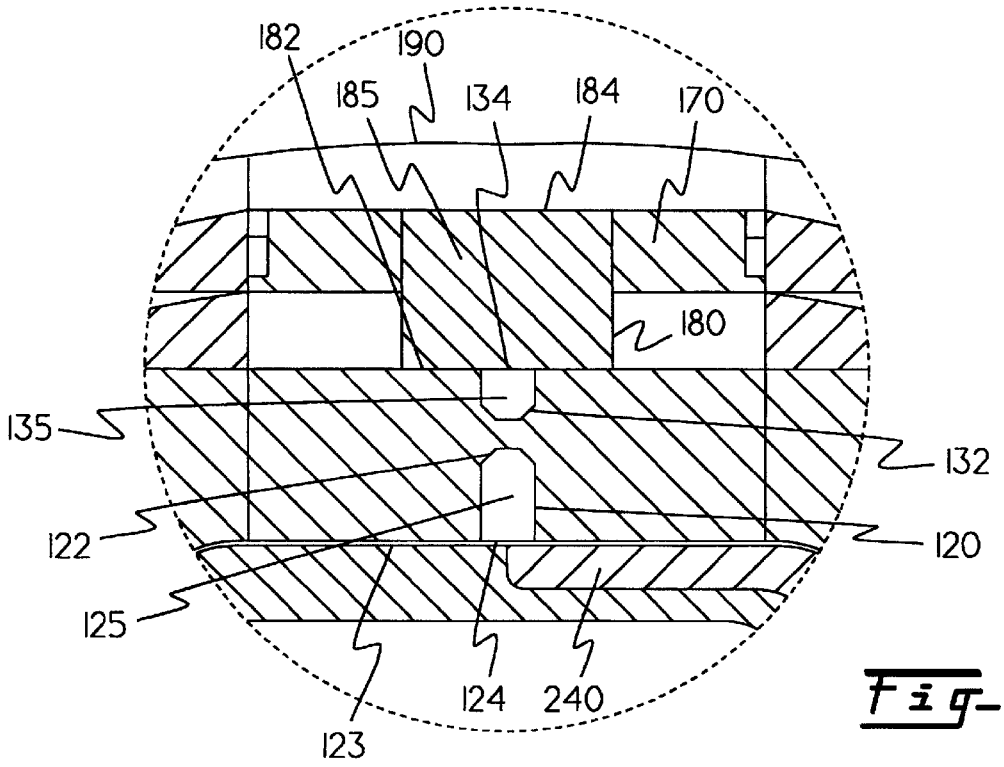
FIG. 2 is an expanded view showing a more detailed schematic of a through bulkhead initiator in accordance with the present invention.

Illustrated in FIG. 1 is a cross sectional view of a through bulkhead initiator, in accordance with the present invention, that is particularly applicable for deployment of a rocket motor. FIG. 2 is an expanded view of a portion of FIG. 1 showing a more detailed schematic of a through bulkhead initiator in accordance with the present invention. The essential components which comprise the through bulkhead initiator, hereafter referred to as "initiator," will now be described with reference to a projectile fuse 10 which is shown, in part, in the Figures.

Now referring to FIG. 1, fuze 10 includes, more generally, a cylindrically shaped or hub-like formed fuze housing 100 and mating aft fuze housing 200 which are coupled together by a threaded coupling technique, or other coupling technique. As illustrated, a generally cylindrically shaped chamber 210 is enclosed by forward fuze housing 100 when mated with aft fuze housing 200. Chamber 210 is intended to provide a volume of space for containing fuze components, not shown, including, by way of example, electronic circuit assemblies, a rocket motor, and the like. Forward fuze housing 100 may also include a channel 110 for containing an O-ring 220 positioned between the forward and aft fuze housing components 100 and 200, respectively, thereby providing a gas tight seal for enclosing components within chamber 210.

Forward fuze housing 100 is generally hub shaped, as aforesaid, and includes an inner side 102 and an outer side 104. Forward fuze housing 100 includes a centrally located bore hole or cavity 120 generally aligned with a central axis of the cylindrically shaped forward fuze housing 100. Now referring particularly to FIG. 2, bore hole 120 is generally defined by a bottom end surface 122 and an open end 124 integral with said inner side 102.

Forward fuze housing 100 also includes cylindrical protrusion 107 extending from outer side 104, and generally aligned with the central axis of forward fuze housing 100. As shown in FIG. 2 in expanded view, protrusion 107 includes a centrally located and cylindrically shaped bore hole or cavity 180 having a generally flat bottom end surface 182 and an open end 184. Extending into forward fuze housing 100 from bottom end surface 184 is a centrally located and cylindrically shaped bore hole or cavity 130, also centrally aligned with the central axis of forward fuze housing 100. Referring again to the expanded view of FIG. 2, bore hole 130 includes a bottom end surface 132 and an open end 134 integral with bottom end surface 182 of cavity 180.

Cavities 120, 130, and 180 are generally cylindrical and axially aligned with the central axis of forward fuze housing 100. Cavities 120 and 130 are so constructed in a manner such that opposite bottom end surfaces 122 and 132 are in juxtaposition so as to be separated by a bulkhead or barrier member integral with fuze housing 100, and which is generally depicted by numeral 140. In a simple configuration, cavities 120 and 130 may be axially aligned bore holes or apertures created by common boring techniques such that the bottom end surfaces 122 and 132, opposite their respective open ends 124 and 134, respectively, are generally described as having a concave end surface as seen from the open ends thereof. Alternatively, other boring techniques are of course possible including those providing a pointed conical shaped surface or a flat grounded surface.

Referring again particularly to FIG. 2, cavity 120 is intended to be press loaded with an explosive donor charge 125, and cavity 130 is intended to be pressed loaded with an explosive acceptor charge 135 through cavity open ends 124 and 134, respectively. Further, cavity 180 is intended to be press loaded with a secondary explosive 185 intended to be detonated by an aft explosion of the acceptor charge 135 as is well understood in the art.

Open end 122 of cavity 120 may be sealed by a foil seal 123 as is well known in the art. Coupled to foil seal 123 and the explosive donor charge 125 enclosed within cavity 120 is an ordnance transfer line depicted as detonator cord 240 which is coupled to detonator cord stimulus, for example an electronic circuit assembly as is generally depicted by reference numeral 245.

Pressed against the open end 124 of cavity 120 and a central portion of side 102 is a closure disk 150 for press fitting the detonator chord to be in communication with the explosive donor charge and thereby provide a somewhat gas tight explosion chamber generally within the confines of cavity 120. As shown in FIG. 1, closure disc 150 may be held in place by threaded engagement within an aperture, generally indicated by numeral 160. Aperture 160 may advantageously be defined in part by side 102 of forward fuze housing 100, or other arrangement, so as to be in fixed arrangement with forward fuze housing side 102 to provide the intended function, i.e. a gas tight explosion chamber within cavity 120.

Fuze 10 further includes an insulator cap 170 configured to mate with portions of outer side 104 of forward fuze housing 100 surrounding protrusion 107. Insulator cap 170 may be held in place by use of a lacquer sealant or other arrangement. A button like closure cap 190 is intended to seal the open end 184 of cavity 180 when loaded with a secondary explosive. Forward fuze housing 100 may also include ignitor flash holes (not shown) as is commonly practiced in such ordinance devices.

In the preferred embodiment of the invention, forward fuze housing 100 is constructed of a nickel alloy which is age hardened. One example of an age hardened nickel alloy is Inconel #718 manufactured by Huntington Alloy Products Division, International Nickel Co., Inc., Huntington, W.V. Inconnel #718 includes nickel in the range of 50–55 per cent by molecular weight.

Having described the invention in detail, the following example embodiment is provided to promote a better understanding of the invention. It will be understood that the invention is not limited by the following example. In an exemplary fuze 10 embodiment, forward fuze housing 100 may have an overall diameter of 3.125 inches and an axial length of 2.00 inches. Aft fuze housing 200 may have an overall a diameter of 3.00 inches and an axial length of 1.6 inches. Cavity 120 and 130 are axially aligned and bored so that the barrier member 140 may have a central thickness of 0.040 inches with the diameter of each cavity being 0.092 inches and the longitudinal lengths of cavity 120 and 130 being 0.190 and 0.105 inches respectively. Bore hole 180 may have a diameter of 0.350 inches and length of 0.250 inches sufficient to contain a secondary explosive pellet of like dimensions. In another example of a through bulkhead initiator fabricated at Alliant Techsystems Inc., a barrier with a thickness of about 0.035 inches was made with acceptable results. In other examples of the invention, the barrier member may have a central thickness ranging from less than 0.050 inches to greater than 0.025 inches.

With the foregoing choice of material and barrier member 140 minimum thickness between the bottom surfaces 122 and 132 of bore holes 120 and 130, a well functioning initiator was produced where the explosive donor charge was PBXN-5, a wellknown plastic bonded explosive, and the explosive acceptor charge was HNS-II. HNS-II (recrystallized production hexanitrostilbene, $C_{14}H_6N_6O_{12}$) is well known to those skilled in the art. The aforementioned explosive acceptor charge was satisfactory for igniting a rocket motor ignitor charge comprised of a pellet of $BKNO_3$ employed as the secondary explosive 185. $BKNO_3$ (boron potassium nitrate) is a well-known ignitor, The foregoing description of the invention is necessarily detailed so as to provide understanding of the invention's best mode of practice. It is to be understood, however, that various modifications of detail, rearrangement, addition, and deletion of components may be undertaken without departing from the invention's spirit, scope, or essence. For example other forms of hexanitrostilbene (HNS) or equivalent materials may be used in place of HNS-II for the explosive acceptor charge.

The embodiments of an invention in which an exclusive property or right is claimed are defined as follows:

1. A miniaturized bulkhead with a barrier member for separating explosive charges on opposites sides thereof, said miniaturized bulkhead comprising:

an explosive donor charge;

an explosive acceptor charge;

an initiator body constructed of substantially an age hardened nickel-base alloy, said initiator body including first and second cavities separated by a barrier member integral with said initiator body, said first cavity substantially filled with said explosive donor charge, said second cavity substantially filled with said explosive acceptor charge, wherein the composition of said age hardened nickel-base alloy includes nickel in the range of 50–55 percent by weight; and wherein said barrier member is less than 0.05 inches thick and is located between said explosive donor charge and said explosive acceptor charge so that a shock wave initiated by detonating said explosive donor charge is transferred through said barrier member to impact said explosive acceptor charge so as to cause detonation of said explosive acceptor charge.

2. The miniaturized bulkhead of claim 1 wherein said explosive donor charge is comprised of PBXN-5, and said explosive acceptor charge is comprised of hexanitrostilbene.

3. The miniaturized bulkhead of claim 2 wherein said explosive donor charge is press loaded into said first cavity and said explosive acceptor charge is press loaded into said second cavity.

4. The miniaturized bulkhead of claim 1 wherein said explosive donor charge is press loaded into said first cavity.

5. The miniaturized bulkhead of claim 4 wherein said explosive donor charge is comprised of PBXN-5.

6. The miniaturized bulkhead of claim 1 wherein explosive acceptor charge is press loaded into said second cavity.

7. The miniaturized bulkhead of claim 6, wherein said explosive acceptor charge is comprised of hexanitrostilbene.

8. The miniaturized bulkhead of claim 1 wherein said explosive donor charge is comprised of PBXN-5, and said explosive acceptor charge is comprised of recrystallized production hexanitrostilbene.

9. A projectile fuse including a miniaturized bulkhead with a barrier member less than 0.05 inches thick for separating explosive charges on opposites sides thereof, said projectile fuse comprising:

an aft housing threadably engaged with an initiator body for forming an inner chamber bounded by said aft housing and said initiator body;

said initiator body constructed of substantially an age hardened nickel-base alloy, wherein the composition of said age hardened nickel-base alloy includes nickel in the range of 50–55 percent by weight, said initiator body having, an aft end member in communication with said inner chamber, and a forward end member, a first cavity inwardly extending into said initiator body ending at a first bottom end surface, a second cavity inwardly extending into said initiator body ending at a second bottom end surface in juxtaposition with said first bottom end surface, where the first bottom end surface and the second bottom end surface are separated by a barrier member integral with said forward housing, an explosive donor charge filling said first cavity, an explosive acceptor charge filling said second cavity; and wherein said barrier member separates said first and second cavities, so that a shock wave initiated by detonating said explosive donor charge is transferred through said barrier member to impact said explosive acceptor charge so as to cause detonation of said explosive acceptor charge.

10. The projectile fuse of claim 9 wherein said explosive donor charge is comprised of PBXN-5, and said explosive acceptor charge is comprised of hexanitrostilbene.

11. The projectile fuse of claim 10 wherein said explosive donor charge is press loaded into said first cavity and said explosive acceptor charge is press loaded into said second cavity.

12. The projectile fuse of claim 9 wherein said explosive donor charge is press loaded into said first cavity and said explosive acceptor charge is press loaded into said second cavity.

13. An initiator body for use in a projectile fuse, said initiator comprising a miniaturized bulkhead with a barrier member having a thickness in the range of less than 0.05 inches thick but more than 0.025 inches thick for separating explosive charges on opposites sides thereof, said miniaturized bulkhead being manufactured from an age hardened nickel-base alloy, said initiator body including first and second cavities separated by said barrier member integral with said initiator body, said first cavity substantially filled with an explosive donor charge, and said second cavity substantially filled with an explosive acceptor charge, and wherein the composition of said age hardened nickel-base alloy includes nickel in the range of 50–55 percent by weight.

14. The initiator body of claim 13 wherein said explosive donor charge is comprised of PBXN-5, and said explosive acceptor charge is comprised of hexanitrostilbene.

15. The initiator body of claim 14 wherein said explosive donor charge is press loaded into said first cavity and said explosive acceptor charge is press loaded into said second cavity.

16. The initiator body of claim 13 wherein said explosive donor charge is press loaded into said first cavity and said explosive acceptor charge is press loaded into said second cavity.

17. The initiator body of claim 13 wherein said explosive donor charge is press loaded into said first cavity.

18. The initiator body of claim 17 wherein said explosive donor charge is comprised of PBXN-5.

19. The initiator body of claim 13 wherein explosive acceptor charge is press loaded into said second cavity.

20. The initiator body of claim 19 wherein said explosive acceptor charge is comprised of hexanitrostilbene.

* * * * *